US006186185B1

(12) United States Patent
Khokar

(10) Patent No.: US 6,186,185 B1
(45) Date of Patent: Feb. 13, 2001

(54) NETWORK-LIKE WOVEN 3D FABRIC MATERIAL

(75) Inventor: Nandan Khokar, Göteborg (SE)

(73) Assignee: Biteam AB, Bromma (SE)

( * ) Notice: Under 35 U.S.C. 154(b), the term of this patent shall be extended for 0 days.

(21) Appl. No.: 09/380,491

(22) PCT Filed: Sep. 9, 1997

(86) PCT No.: PCT/SE97/00355

§ 371 Date: Sep. 2, 1999

§ 102(e) Date: Sep. 2, 1999

(87) PCT Pub. No.: WO98/39507

PCT Pub. Date: Sep. 11, 1998

(51) Int. Cl.[7] ..... D03D 41/00
(52) U.S. Cl. ..... 139/1 R; 139/11; 139/DIG. 1
(58) Field of Search ..... 139/DIG. 1, 11, 139/1 R

(56) References Cited

U.S. PATENT DOCUMENTS 4,615,256 10/1986 Fukuta et al. ..... 87/33
5,242,768 * 9/1993 Nagatsuka et al. ..... 429/127
5,451,448 9/1995 Sawko et al. ..... 428/175
5,465,760 * 11/1995 Mohamed et al. ..... 139/11
5,665,451 * 9/1997 Dorn et al. ..... 428/116

FOREIGN PATENT DOCUMENTS 4342575 4/1995 (DE) .

* cited by examiner

*Primary Examiner*—John J. Calvert
*Assistant Examiner*—Robert H. Muromoto, Jr.
(74) *Attorney, Agent, or Firm*—Birch, Stewart, Kolasch & Birch, LLP

(57) ABSTRACT

A network-like woven 3D fabric material (9) comprises select multilayer warp yarns (8) occurring substantially linearly, the remainder multilayer warp yarns (7) occurring in the helical configuration and two orthogonal sets of weft (12*c* and 12*r*) and such a network-like fabric construction (9) made possible through a dual-directional shedding operation of the weaving process. Such a fabric may additionally incorporate non-interlacing multi-directionally oriented yarns (n1–n8) across the fabric cross section to improve the fabric's mechanical performance. The produced 3D fabric material, which may be cut into any desired shape without the risk of splitting, may be used wholly or in parts in technical applications.

7 Claims, 11 Drawing Sheets

NETWORK-LIKE WOVEN 3D FABRIC MATERIAL

This application is the national phase under 35 U.S.C. §371 of PCT International Application No. PCT/SE97/00355 which has an International filing date of Mar. 3, 1999 which designated the United States of America.

TECHNICAL FIELD

This invention relates to a woven 3D fabric and it method of production. In particular, the woven 3D fabric comprises select multilayer warp yarns occurring substantially linearly, the remainder multilayer warp yarns occurring in a helical configuration and two orthogonal sets of weft and such a network-like fabric construction made possible through a dual-directional shedding operation of the weaving process. Such a fabric, which may additionally incorporate non-interlacing multi-directionally orientated yarns across the fabric cross-section for improving its mechanical performance, is considered useful in technical applications like the manufacture of composite materials, filters, insulating materials, separator-cum-holder for certain materials, electrical/electronic parts, protection material, etc.

BACKGROUND

In the conventional weaving process the foremost operation of shedding is limited in its design to form a shed in only the fabric-width direction. The employed warp, which is either in a single or a multiple layer, is separated into two parts in a 'crossed' manner, in the direction of the fabric-thickness through the employment of the heald wires which are reciprocated through their frames by means such as cams or dobby or jacquard to form a shed in the fabric-width direction. Each of these heald wires are reciprocated either singly or jointly or in suitable groups in only the fabric-thickness direction to form a shed in the fabric-width direction. A weft inserted into this formed shed enables interconnection between the separated two layers of the warp. The so interconnected warp and weft results in an interlaced structure which is called the woven fabric. A fabric when produced using a single layer warp results in a sheet-like woven material and is referred to as a woven 2D fabric as its constituent yarns are supposed to be disposed in on plane. Similarly, when a fabric is produced using a multiple layer warp, the obtained fabric which is characteristically different in construction from the woven 2D fabric, is referred to as a woven 3D fabric because its constituting yarns are supposed to be disposed in a three mutually perpendicular plane relationship. However, in the production of both these types of woven 2D and 3D fabrics the conventional weaving process, due to its inherent working design, can only bring about interlacement of two orthogonal sets of yarn: the warp and the weft. It cannot bring about interlacement of three orthogonal sets of yarns: a multiple layer warp and two orthogonal sets of weft. This is an inherent limitation of the existing weaving process. The present invention provides a dual-directional shedding method to form sheds in the columnwise and the row-wise directions of a multilayer warp to enable interlacement of the multilayer warp and two orthogonal sets of weft in such a way that select yarns of the multilayer warp occur substantially linearly and the remainder yarns, which interlace with the two orthogonal sets of weft, occur in a helical configuration and the obtained fabric has a network-like structure.

Certain technical fabric applications require complex or unusual shapes besides other specific characteristics for performance such as a high degree of fabric integration and proper orientation of the constituent yarns. For example, at present it is not possible to obtain a suitable fabric block from which preforms (reinforcement fabric for composite material application) of any desired shape may be cut obtained. This is because the present fabric manufacturing processes of weaving, knitting, braiding and certain non-woven methods which are employed to produce preforms cannot deliver a suitable highly integrated fabric block from which preforms of any desired shape may be cut obtained. With a view to obtain certain regular cross-sectional shaped preforms, suitable fabric manufacturing methods working on the principles of weaving, knitting, braiding and certain nonwoven techniques have been developed. Such an approach of producing preforms having certain cross-sectional shapes is referred to as near-net shaping. However, through these various techniques preforms of only certain cross-sectional profiles can be produced and preforms of any desired shape cannot be manufactured. The obtaining of preforms of any desired shape can be made practically possible if only a highly integrated fabric block can be made available so that the required shape can be cut from it without the risk of its splitting up. Also, fabrics for other applications like filters of unusual shapes can be similarly cut obtained from a suitable fabric block. For analogy, this strategy of obtaining any desired shape of three-dimensional fabric item may be seen as the cutting of different shapes of fabric items from a suitable sheet of 2D fabric, for example, during the manufacture of a garment. Therefore, as can be inferred now, to cut obtain three-dimensional fabric items of any desired shape it is essential to first produce a highly integrated fabric in the form of a block. The present invention provides a novel woven 3D fabric and the method to produce such a fabric block which can be cut without the risk of splitting up and which may additionally incorporate non-interlacing yarns in a multi-directional orientation to impart mechanical performance to the fabric, so as to be useful in technical applications.

OBJECTIVES OF THE PRESENT INVENTION

An objective of this invention is to make available a block of network-like integrated 3D fabric which additionally incorporates yarns suitably orientated to impart proper mechanical strength to the fabric so that suitable fabric items of any desired shape can be cut without the risk of its splitting up. Because certain fabrics items of any desired shape may be obtained easily this way, such an approach can be advantageous in technical applications such as the manufacture of preforms, i.e. reinforcement fabric for compsites application, filters etc.

Another objective of this invention is to provide a dual-directional shedding method to enable interlacement of three orthogonal sets of yarn: a set of multilayer warp and two orthogonal sets of weft. Such an interlacement of the three orthogonal sets of yarn is necessary to provided a high degree of integrity to the fabric to render the fabric resistant to splitting up in the fabric-width as well as in the fabric-thickness directions. This way the objective of producing a network-like interlaced 3D fabric, which may additionally incorporate non-interlacing multi-directionally oriented yarns, is made possible.

The integrity of the fabric is made possible through the formation of multiple row-wise and columnwise shed in the employed multiple layer warp. Two orthogonal sets of weft when inserted in the formed row-wise and columnwise shed produce a network-like interlaced 3D fabric. Because the foremost operation of the weaving process happens to be the shedding operation, all other subsequent complementing operations of the weaving process, for example picking, beating-up etc., will follow suit accordingly. As the dual-directional shedding method enables interlacement of two orthogonal sets of weft and a multilayer warp by way of forming sheds in the columnwise and row-wise directions of the multilayer warp to produce a highly integrated network-like fabric structure having a high mechanical performance, it will be described in detail. The subsequent complementing weaving operations like picking, beating-up, taking-up, letting off etc. will not be described as these are not the objectives of this invention. With a view to keep the description simple and to the point, the simplest mode of carrying out the dual-directional shedding operation will be exemplified and will only pertain to the production of the woven plain weave 3D fabric according to this invention. The method of producing numerous other weave patterns through this invention will be apparent to those skilled in the art and therefore it will be only briefly mentioned as these various weave patterns can be produced on similar line without deviating from the spirit of this invention.

BRIEF DESCRIPTION OF THE DRAWINGS

The invention is described in reference to the following illustrations.

DESCRIPTION OF THE PREFERRED EMBODIMENTS

The method of producing the woven 3D fabric using two orthogonal sets of weft and a multilayer warp will now be described in reference to the above stated drawings. The working principle of the dual-directional shedding method will be described first and then the particular way of constructing useful fabrics according to this invention will be described.

Figure 1:
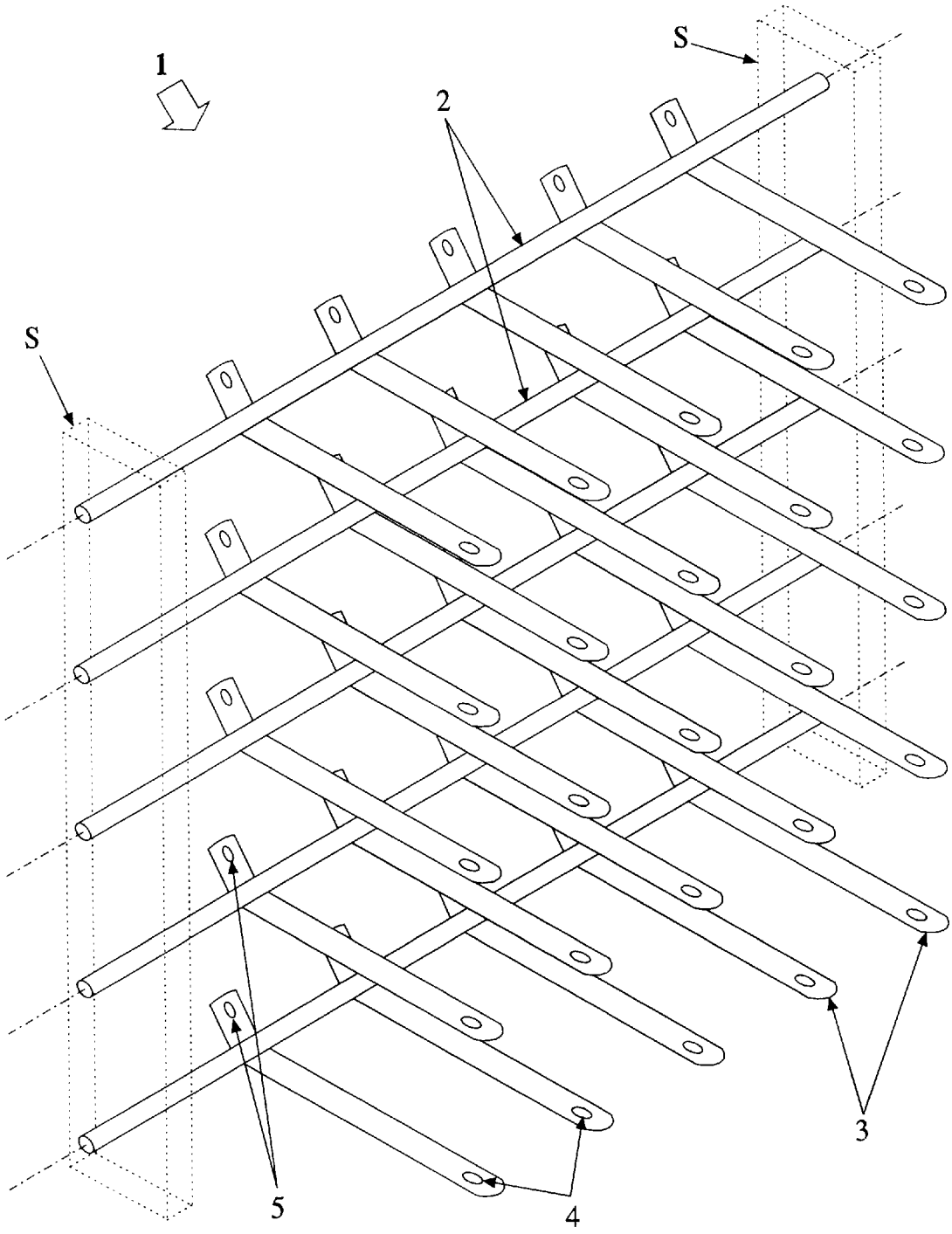
FIG. 1 shows the general arrangement of the shedding shafts for carrying out dual-directional shedding.

The method to be described now follows a completely new plan for effecting shedding compared with the conventional shedding methods. In FIG. 1 is shown the essential features of the novel dual-directional shedding arrangement (1) for effecting shed formation in the fabric-width and -thickness directions. Each of the cylindrical heald shaft (2) and the flat healds (3) as indicated. Each heald has two openings: the front one is the heald-eye (4) and the rear one is a heald-guide (5). Such an assembly comprising the cylindrical heald shaft (2) and the flat healds (3) is suitably supported in support(s), as indicated in FIG. 1, in a manner that each of these assemblies can be reciprocated in two directions: (i) along and (ii) about the shaft axis; that is linearly and angularly respectively.

Figure 2:
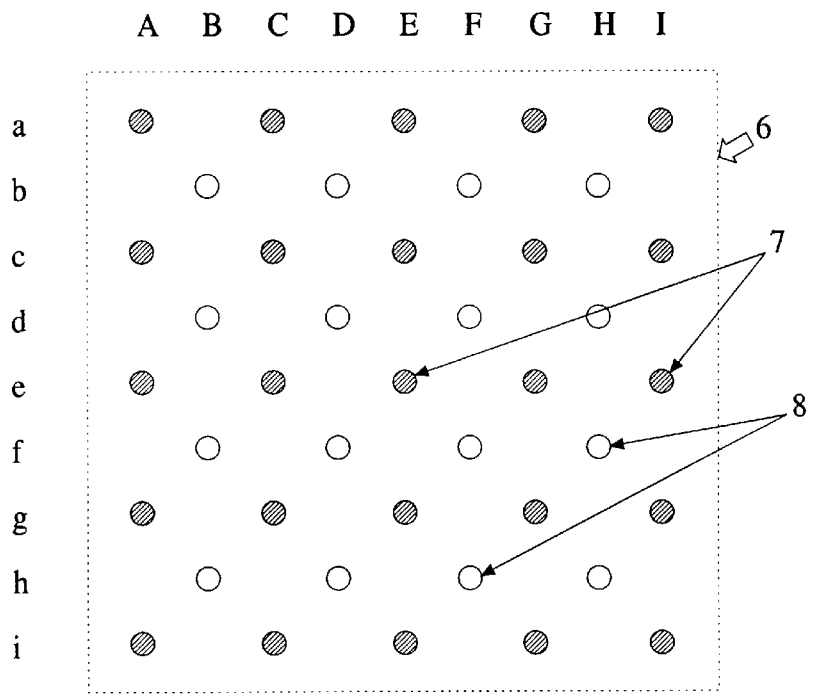
FIG. 2 shows the disposal arrangement of the active and the passive warp yarns comprising the multilayer warp.

The disposal arrangement of the employed multilayered warp (6) is indicated in FIG. 2. Such a disposal is required to achieve a uniform integration at the fabric's surfaces (excluding end surfaces) and for the balanced distribution of the yarns in the fabric. The peculiarity of this arrangement is that it comprises active (7) and passive (8) warp yarns such that each passive warp end (8) is 'surrounded' by active warp ends (7) for achieving uniform fabric integration. Such a multilayer warp disposal arrangement (6) may be described as comprising alternate rows or columns of active (7) and passive (8) warp ends. Thus, the active-warp yarn rows will be designated by 'a', 'c', 'e' etc. and the passive-warp yarn rows by 'b', 'd', 'f' etc. as indicated in FIG. 2. The occurring alternate columns of the active (7) and passive (8) warp yarns will be designated by 'A', 'C', 'E' etc. and 'B', 'D', 'F' etc. respectively as indicated in FIG. 2. Each of the active warp ends (7) of a given row (or column) is drawn through the corresponding flat heald's (3) guide (5) and the eye (4). The passive warp yarns (8) of a given row (or column) are drawn through the open space occurring between corresponding two adjacent heald shafts (2). Thus, the multilayer warp yarns (6) and the heald shafts (2) will occur as indicated in FIG. 3.

Figure 3:
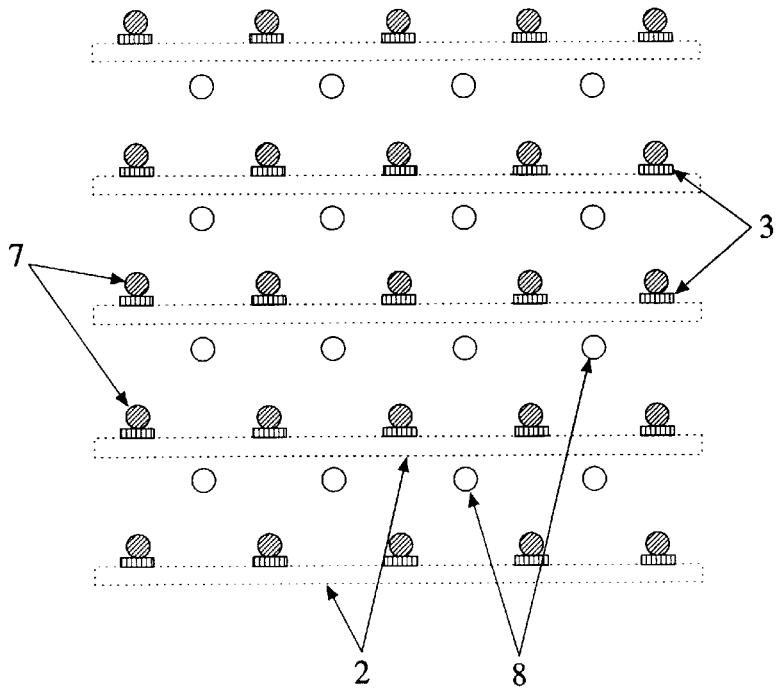
FIG. 3 shows the location of the shedding shafts in relation to the passive yarns of the multilayer warp indicated in FIG. 2.
Figure 4A:
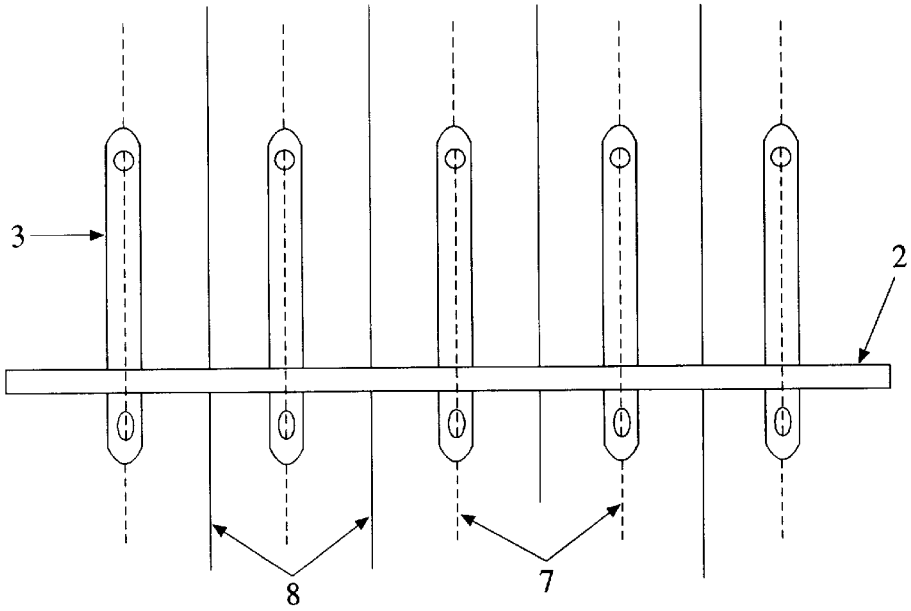
FIG. 4*a* shows the top view of the level position of the shedding shafts and the multilayer warp prior to columnwise shed formation.
Figure 4B:
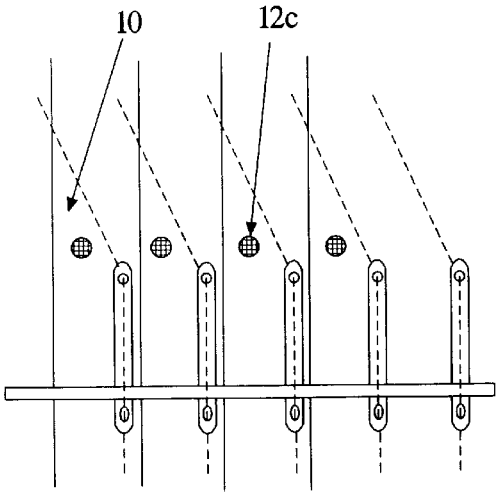
FIG. 4*b* shows the top view of the shedding shafts displacing the active warp yarns drawn through its eyes towards the right side of the passive warp yarns and the formation of the multiple right side columnwise sheds with the passive warp yarns.
Figure 4C:
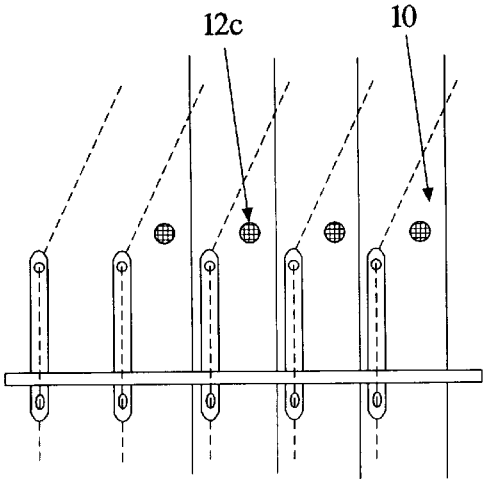
FIG. 4*c* shows the top view of the shedding shafts displacing the active warp yarns drawn through its eyes toward the left side of the passive warp yarns and the formation of the multiple left side columnwise shed with the passive warp yarns.
Figure 5A:
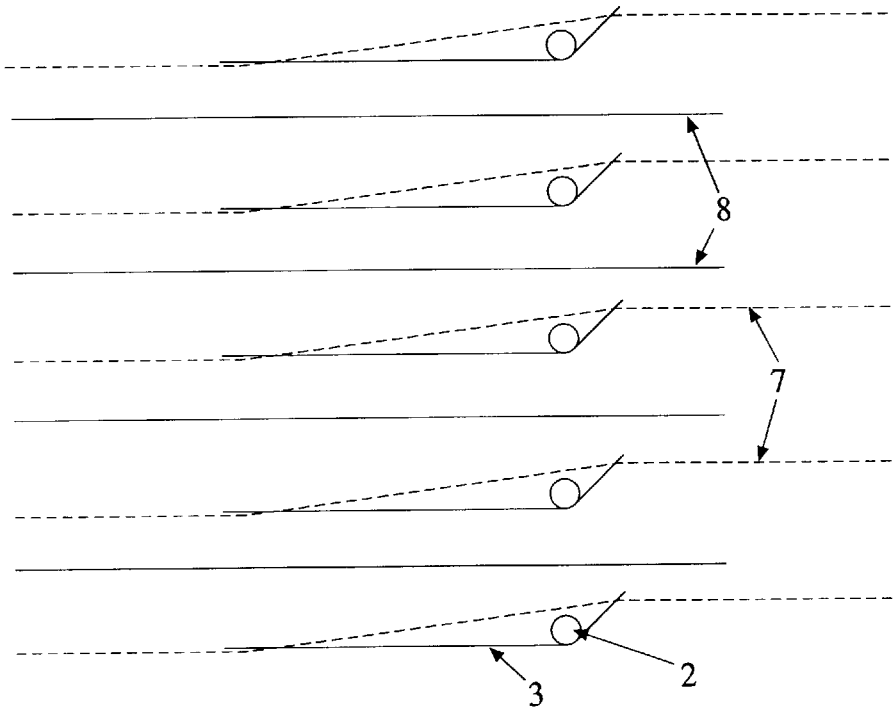
FIG. 5*a* shows the side view of the level position of the shedding shafts and the multilayer warp prior to row-wise shed formation.
Figure 5B:
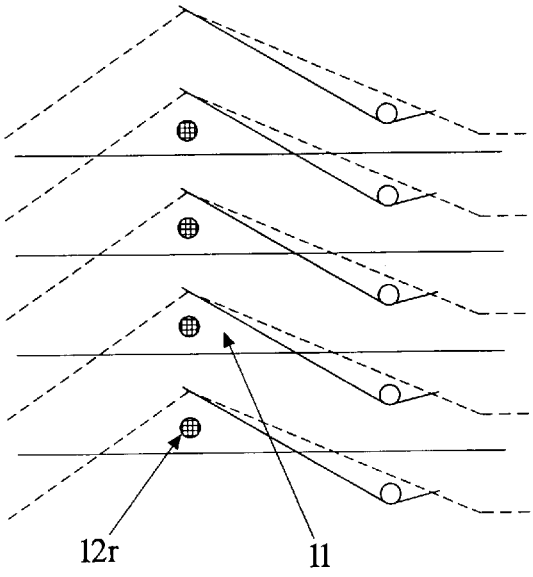
FIG. 5*b* shows the side view of the shedding shafts displacing the active warp yarns drawn through its eyes in the upward direction to form the multiple upper row-wise sheds with the passive warp yarns.
Figure 5C:
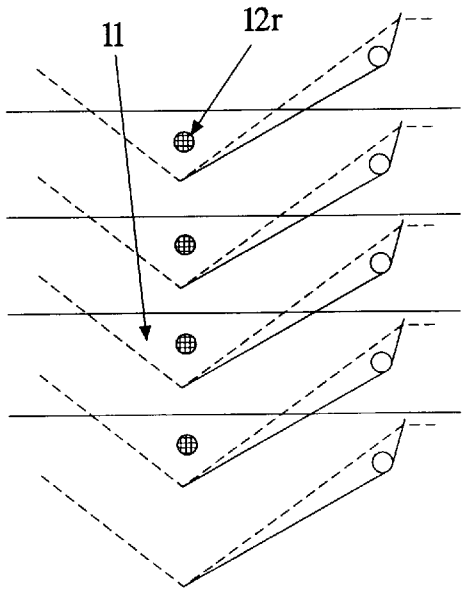
FIG. 5*c* shows the side view of the shedding shafts displacing the active warp yarns drawn through its eyes in the downward direction to form the multiple lower row-wise sheds with the passive warp yarns.

The above described disposal arrangement of the multilayer warp (6) and the shedding shaft (2) shown in FIG. 3 defines the level position of the system. From this level position, each of the active warp ends (7) passing through a corresponding heald eye (4) can be displace in the fabric-width and -thickness directions by moving the heald shaft (2) along its axis and turning it about is axis respectively. In relation to the passive warp ends (8), which do not pass through the heald eyes (4), and hence are stationary, the displaceable active warp ends (7) readily form multiple columnwise (10) and row-wise (11) sheds upon their displacement in the required direction form the level position as shown in FIGS. 4 and 5. The linear and the angular displacements of the heald shafts (2) from its level position to form the row-wise (11) and the columnwise (10) sheds can correspond to the distance between two adjacent active (7) (or passive (8)) warp yarns in the given direction of movement and may be referred to as the shedding displacement pitch. In the formation of these multiple sheds (10) and (11), the displacement of the active warp ends (7) of a given row or column may thus be referred to as a unit shedding displacement pitch. However in real practice this displacement can be increased up to a maximum of 1.5 times the shedding displacement pitch to form a correspondingly greater shed for practical advantage in weft insertions.

In its simplest mode, all the shafts (2) are moved simultaneously, either linearly or angularly, and in the same direction to form corresponding directional movement's multiple sheds as shown in FIGS. 4 and 5 respectively. By picking a weft (12) in each of these formed sheds (10) and (11), interlacement within the individual columns and the rows of the multilayer warp (6) with the corresponding wefts (12*c* and 12*r*) is achieved. Such an alternate row-wise and columnwise shedding and corresponding picking thus leads to the production of the plain weave 3D of this method. The typical yarn paths at the edges and the surfaces of the fabric (9), and in the interiors of fabric (9) are respectively indicated in FIGS. 6*a* and 6*b*. The simplest working of this dual-directional shedding system (1) is outlined below in reference to FIGS. 4 and 5.

In FIG. 4 is illustrated the formation of the columnwise sheds (10). FIG. 4(*a*) indicated the level position of the system. In FIGS. 4(*b*) and (*c*) are shown the directions of the linear movement of a heald shaft (2) along its axis. The former and the latter figures respectively show the displacement of the active warp ends (7), from their level positions, in the fabric-width direction to form the right side and the left side columnwise sheds (10) with the stationary passive warp yarns (8). FIG. 5 shows the formation of the row-wise sheds (11). FIG. 5(*a*) indicates the level position of the system. In FIGS. 5(*b*) and (*c*) are illustrated the directions of the angular movement of a heald shaft (2) about its axis. The former and the latter figures respectively show the displacement of the active warp ends (7), from their level positions, in the fabric-thickness direction to form the upper and lower row-wise sheds (11) with the stationary passive warp yarns (8).

As can be inferred from the FIGS. 4(*b*) and (*c*) and 5(*b*) and (*c*), the optimum displacement of the shafts can be up to 1.5 times the shedding displacement pitch in practice to obtain relatively larger sheds for convenience in weft insertion. The shafts may be displaced up to the extent that an active warp yarn (7) does not cross two passive warp yarns (8).

It is to be noted that in reference to the stationary passive warp yarns (8), the right and the left side columnwise sheds, and the upper and the lower row-wise sheds are not formed simultaneously but in a specific order. The shedding shafts (2) revert to their level position every time subsequent to a particular shed formation and picking operation. For example, in the construction of the plain weave woven 3D fabric (9) obtainable through this method, and indicated in FIG. 6, the order of shedding and picking indicated below is followed, starting from the level position of the system. The movements of the shedding shafts described below are viewed from the rear of the shedding means in the direction of the fabric-fell.

1) Upward angular movement of the shedding shafts (2); formation of the row-wise upper sheds (11); followed by pick insertion in the formed sheds (i.e. in the fabric-width direction)

2) Reverting shedding shafts (2) to the level position of the system

3) Rightward linear movement of the shafts (2); formation of the columnwise right side sheds (10); followed by pick insertion in the formed sheds (i.e. in the fabric-thickness direction)

4) Reverting shafts (2) to the level position of the system

5) Downward angular movement of the shafts (2); formation of the row-wise lower sheds (11); followed by pick insertion in the formed sheds (i.e. in the fabric-width direction)

6) Reverting shafts (2) to the level position of the system

7) Leftward linear movement of the shafts (2); formation of the columnwise left side sheds (10); followed by pick insertion in the formed sheds (i.e. in the fabric-thickness direction)

8) Reverting shafts (2) to the level position of the system.

Figure 6A:
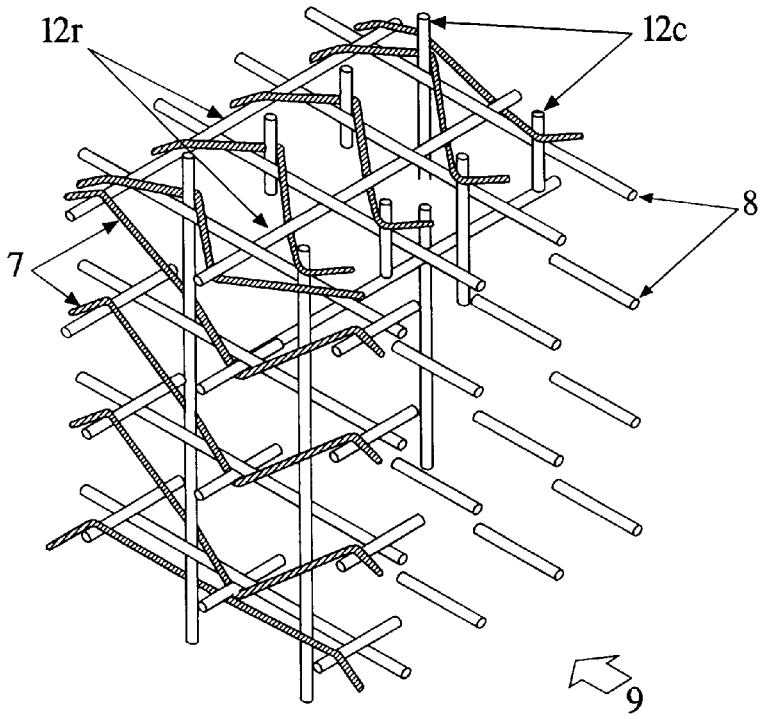
FIG. 6*a* is a three-dimensional representation of the typical yarn paths of the active warp yarns at the edges and the surfaces of the plain weave construction of the woven 3D fabric.
Figure 6B:
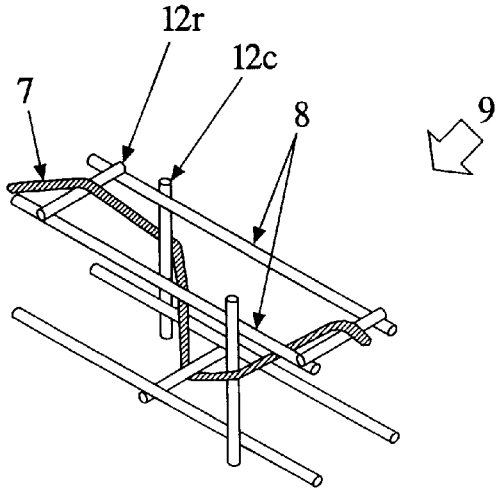
FIG. 6*b* is a three-dimensional representation of the typical yarn paths of the active warp yarns at the interiors of the plain weave construction of the woven 3D fabric.
Figure 7:
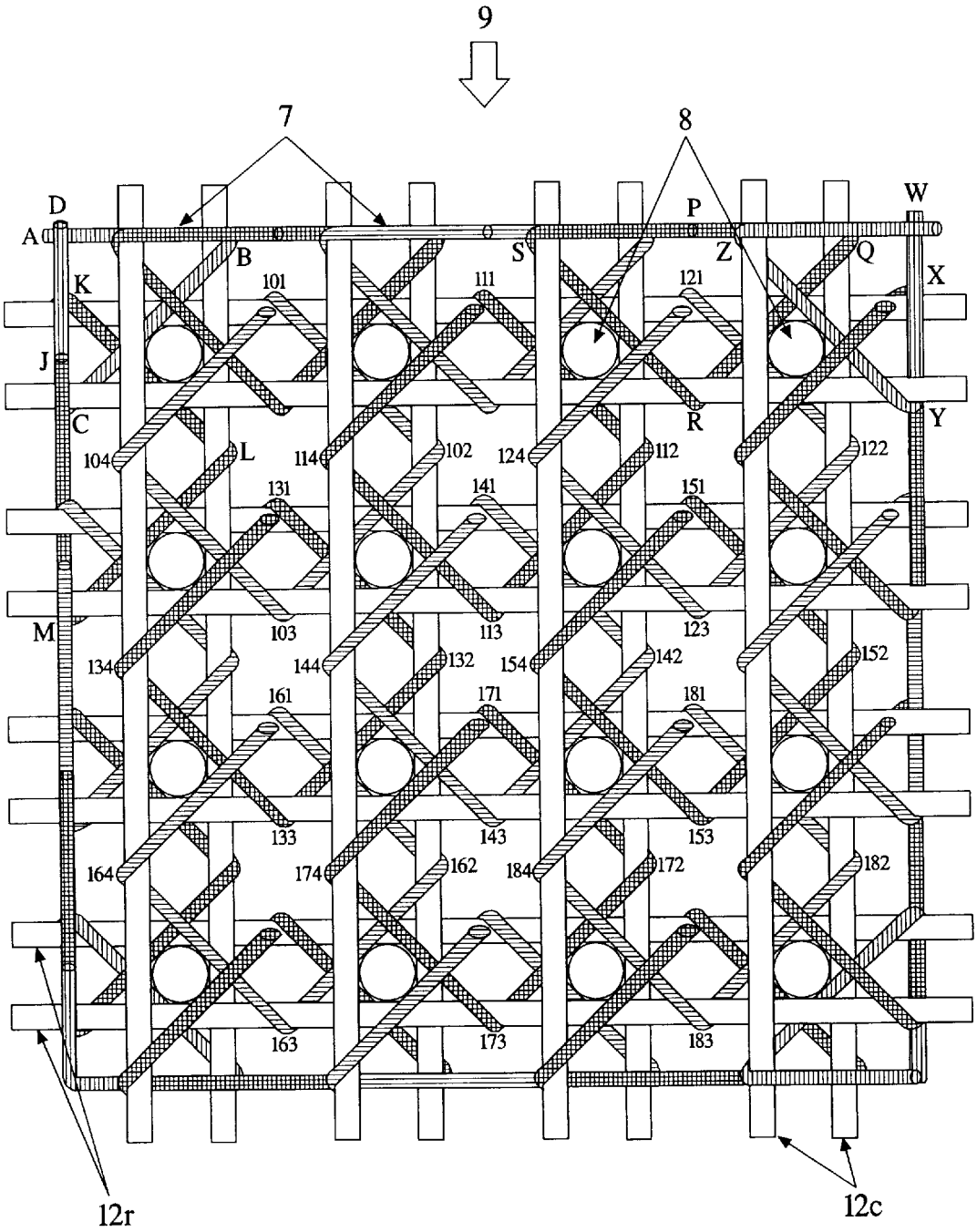
FIG. 7 is a two-dimensional representation of the front view of the fabric construction shown in FIG. 6.
Figure 8A:
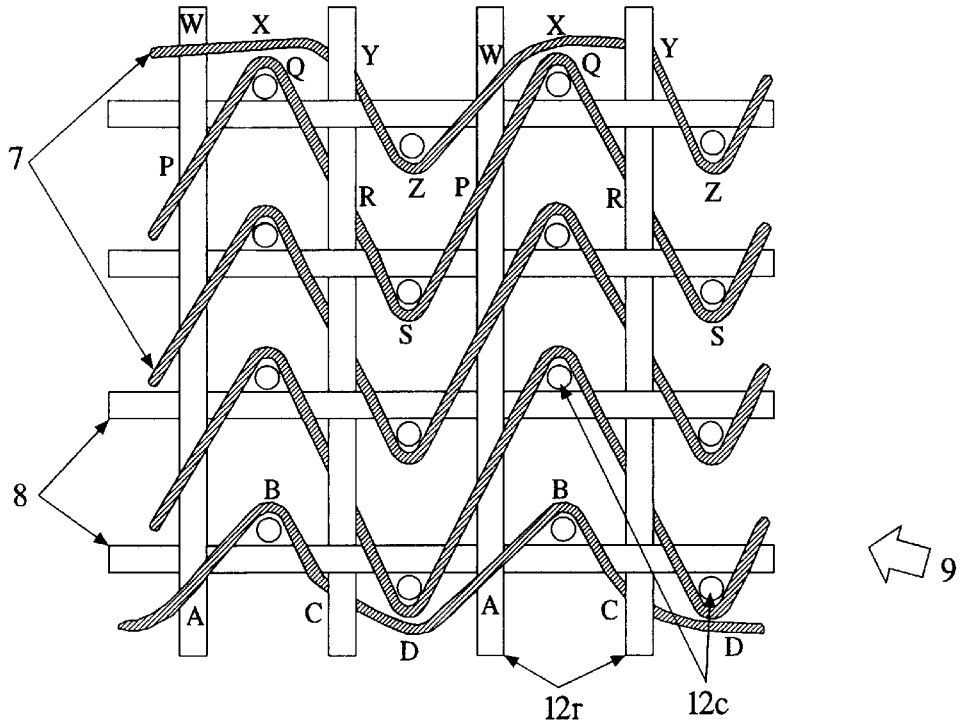
FIG. 8*a* is a two-dimensional representation of the top view of the fabric construction shown in FIG. 6*a*.
Figure 8B:
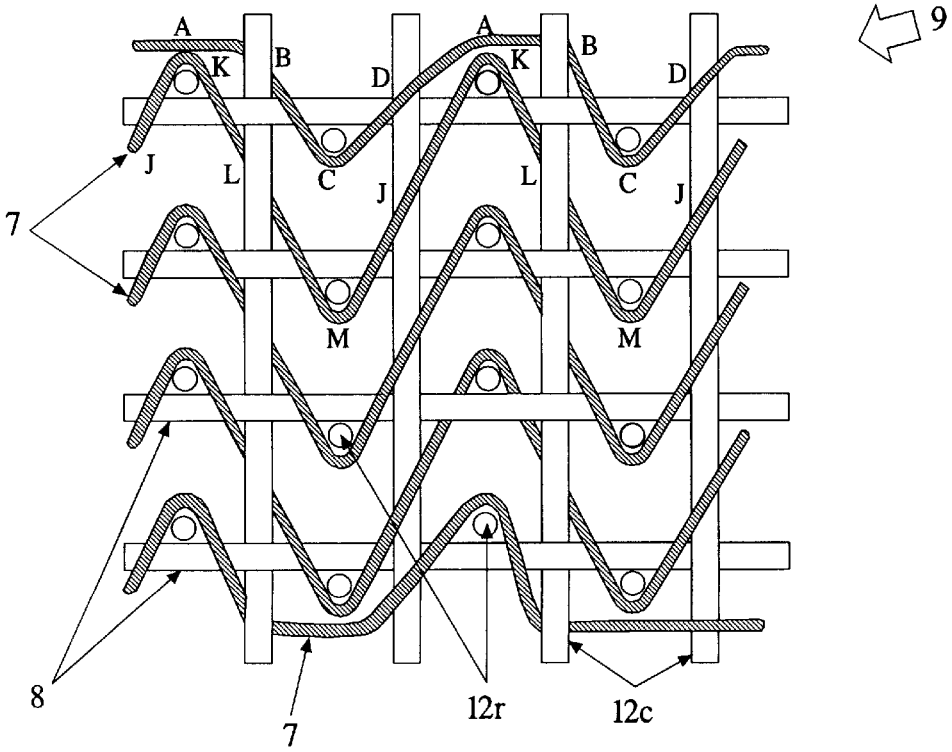
FIG. 8*b* is a two-dimensional representation of the side view of the fabric construction shown in FIG. 6*a*.
Figure 9A:
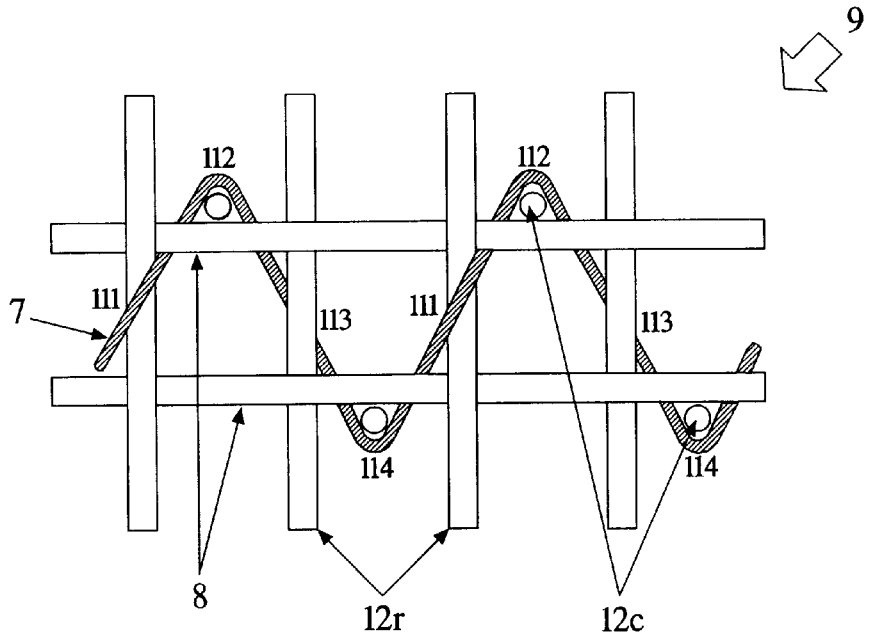
FIG. 9*a* is a two-dimensional representation of the top view of the fabric construction shown in FIG. 6*b*.
Figure 9B:
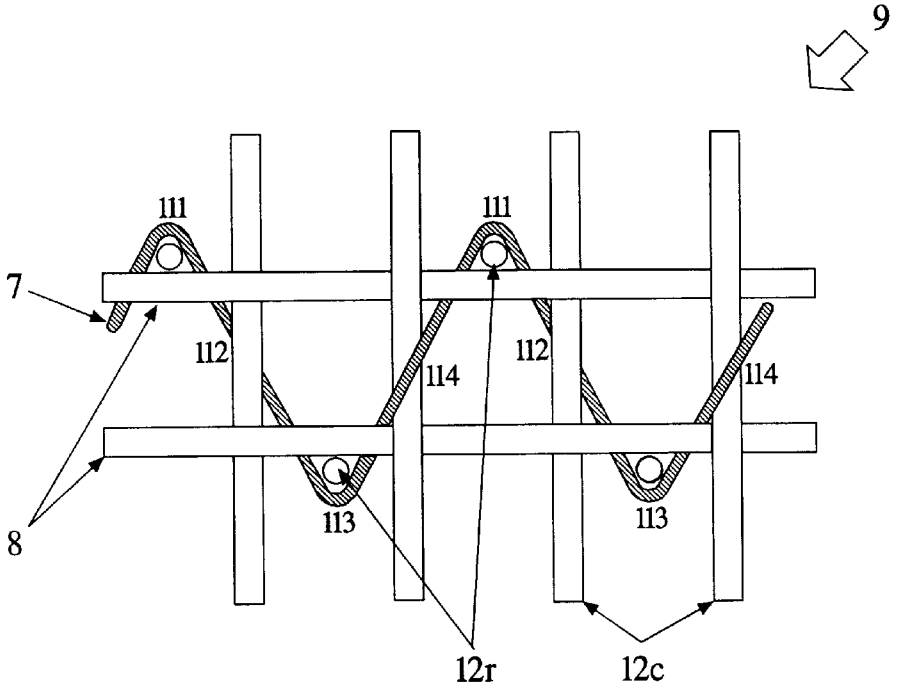
FIG. 9*b* is a two-dimensional representation of the side view of the fabric construction shown in FIG. 6*b*.

The above indicated shedding order, together with the necessary complementing operations of the weaving process like picking, beating-up, taking-up etc. at appropriate moments constitute one complete working cycle of the process. FIG. 7 shows the front view of the plain weave woven 3D fabric construction (9) obtainable through the above stated shedding order. It is to be noted that the two sets of weft (12*c* and 12*r*), which may be inserted in their respective sheds by employing means like shuttles, rapiers etc. and may be picked in as either a single yarn or hairpin-like folded yarn, uniquely interlace with the active warp yarns (7) and get connected to the passive warp yarns (8). Because of their interlacement with the active warp yarns (7) the two sets of weft (12*c* and 12*r*) will occur in an undulating manner and not straight as indicated in FIGS. 6 and 7. These two sets of weft (12*c* and 12*r*) are shown straight for only easy representation. However, the incidence of its crimp can be reduced, for example, by feeding the active warp yarns (7) under suitable tension and at a suitable rate. In FIGS. 8*a* and 8*b* are shown the top and the side views respectively of the fabric (9) to indicate the typical paths of the active warp yarns (7) at the fabric's edges and surfaces. The series of letters A-B-C-D, P-Q-R-S etc. respectively indicate the individual active warp yarn (7) paths at the edges and surfaces of the fabric construction shown in FIGS. 6*a* and 7. In FIGS. 9*a* and 9*b* are shown the top and the side views respectively of the fabric (9) to indicate the typical path of the active warp yarn (7) in the interior of the fabric construction shown in FIG. 6*b*. The series of numbers 111-112-113-114 indicates the individual active warp yarn (7) path in the interior of the fabric construction shown in FIGS. 6*b* and 7.

An important feature of the fabric construction (9) to be noted in FIGS. 6, 7, 8 and 9 is the occurrence of the active warp yarns in the 'helical' configuration. Though not following a circular path, the active warp yarns occur in a 'triangular helix' at the fabric's edges and surfaces (indicated by different series of letters. A-B-C-D, P-Q-R-S etc. in FIG. 7) and in a 'square helix' in the interiors (indicated by different series of numbers, 101-102-103-104, 131-132-133-134 etc. in FIG. 7). Further, both these helices are not formed about any of the passive warp yarns. Also, the fabric has a network-like construction.

There may be introduced minor alteration in the above framework of operations. For example, the above indicated order of shedding operations may be altered to produce a modified network-like fabric construction (9*m*) shown in FIG. 10. In reference to the shedding order indicated above, if the order given below is carried out, then modified network-like fabric constructions (9*m*) may be obtained and will correspond with those indicated in FIG. 10 in which the general path of the active warp yarn in the interior of the fabric is only shown and corresponds as follows:

a) Shedding order: 1, 2, 5, 6, 3, 4, 7, 8 and repeat b) Shedding order: 1, 2, 5, 6, 7, 8, 3, 4 and repeat c) Shedding order: 1, 2, 5, 6, 3, 4, 7, 8, 1, 2, 5, 6, 7, 8, 3, 4 and repeat.

Figure 10A:
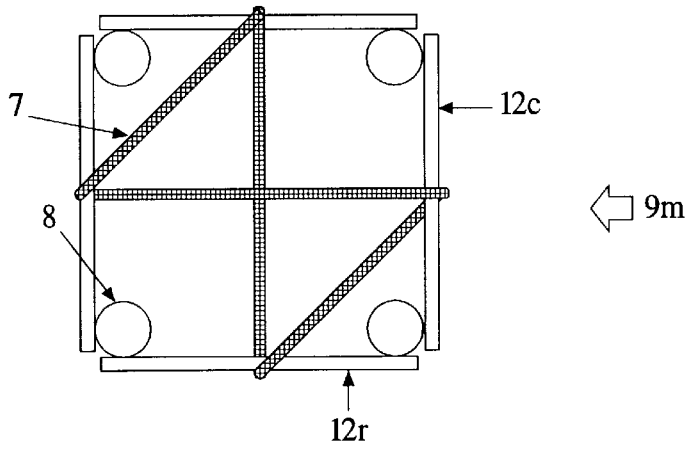
FIG. 10*a* is a two-dimensional representation of the axial view of a modified fabric construction showing the path of the active warp yarns obtainable according to a specific shedding order.
Figure 10B:
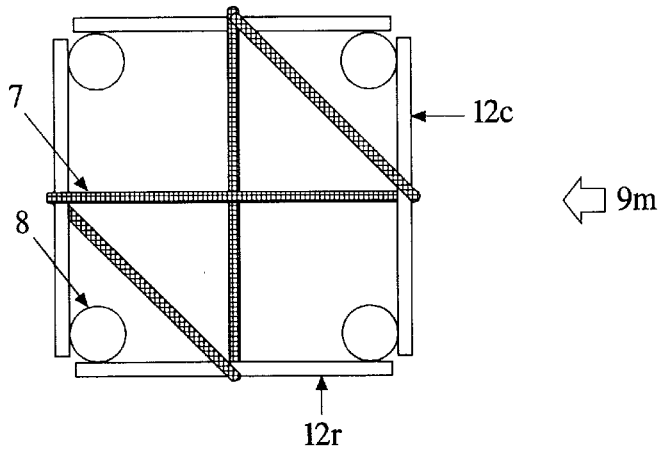
FIG. 10*b* is a two-dimensional representation of the axial view of a modified fabric construction showing the path of the active warp yarns obtainable according to a specific shedding order.
Figure 10C:
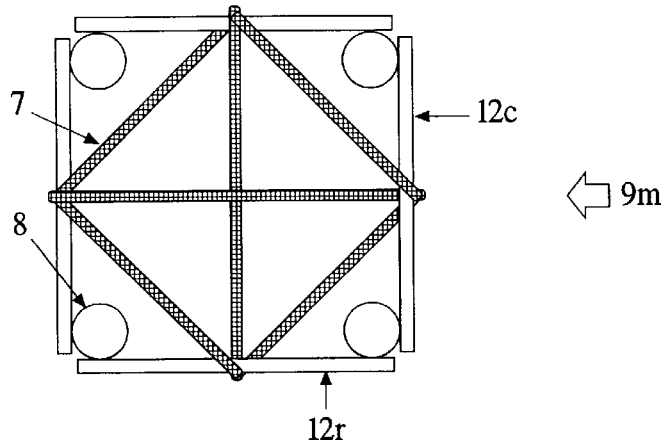
FIG. 10*c* is a two-dimensional representation of the axial view of a modified fabric construction showing the path of the active warp yarns obtainable according to combined specific shedding orders indicated in FIGS. 10*a* and 10*b*.

These obtained modified network-like fabric constructions (9*m*) shown in FIG. 10 will differ from the one indicated in FIGS. 6, 7, 8 and 9 in which the typical paths of the active warp yarns (7) in accordance with the initially mentioned shedding order are indicated. The difference in the fabric construction (9*m*) due to the change of the shedding order will be that the wefts of a given set will occur successively and not alternately as shown in the figures, and also the active warp yarns (7) will additionally occur in the fabric-width and -thickness directions in addition to the diagonal directions as represented in FIG. 10. This is because the wefts (12*c* and 12*r*) will be picked successively in the 'forward and backward' directions of the respective side (row-wise or columnwise direction). Nevertheless, the active warp yarns (7) in all these constructions (9) and (9*m*) may be considered to occur in a helical configuration for the purpose of easy understanding.

From the foregoing description of the dual-directional shedding method, the following points will be apparent to those skilled in the art.

a) All the columnwise (or the row-wise) sheds can be formed simultaneously for increased production efficiency and not successively one columnwise (or row-wise) warp layer after the other.

b) Multiple wefts of a set may be picked simultaneously employing means like shuttles, rapiers etc. and each of the wefts may be inserted as either a single yarn or hairpin-like folded yarn.

c) The active warp yarns (7) may be made to occur in the fabric-length direction either in a helical configuration or additionally in the fabric-width and -thickness directions by controlling the shedding order.

d) The helical progression of all the active warp yarns (7) provides unique network-like fabric integration throughout the fabric by interlacing with the two sets of weft and interconnecting these two sets of weft to the passive warp yarns.

e) The helical progression of the active warp yarns (7) provides unique discrete placement of the active warp yarns (7) in either the 'diagonal' directions or additionally in the fabric-width and -thickness directions.

f) The optimum shedding displacement pitch of the shedding shaft (2) in the fabric-thickness and the -width directions is 1.5 since a greater displacement will cause interference with the pick insertion and unnecessary concentration of the active warp yarns (7) at the fabric's surfaces and thus lead to uneven fabric surface and unbalanced fabric construction.

g) Different weave patterns can be created by displacing independently and selectively in the fabric-width and -thickness directions the required shafts (2) which bear the healds (3) which are suitably threaded.

h) It is possible to carry out shedding involving only the active warp ends (7) by displacing independently pairs of the shafts (2) in opposite directions, and the healds (3) of which are suitably threaded.

i) Tubular fabrics of either square or rectangle cross-section and solid profiled fabrics like L, T, C etc. can be directly produced by disposing the multilayer warp in accordance with the cross-sectional profile to be produced and suitably effecting the shedding and the picking operations in a suitable discrete manner, for example by employing more than one set of picking means in each of the two directions.

It will now be apparent to those skilled in the art that the mechanical performance of the fabric can be improved, if required, by the inclusion of non-interlacing 'stuffer' yarns in the fabric-width, -thickness and the two diagonal directions across the fabric cross-section. An example of one such construction is outlined below.

Figure 11:
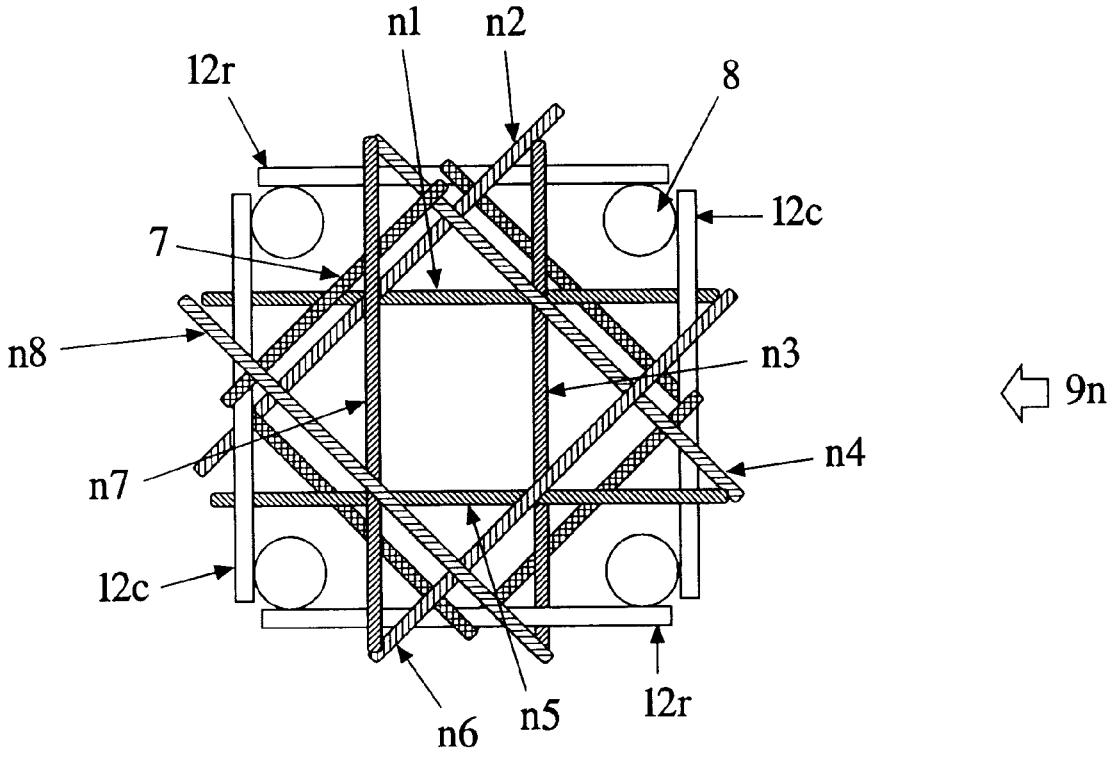
FIG. 11 is the front view of the fabric construction incorporating additional non-interlacing yarns in the fabric-width, -thickness and the two diagonal directions.

In reference to the shedding and picking order mentioned earlier, the insertion of non-interlacing yarns (n1–n8) may be included in the fabric according to the steps indicated below and illustrated in FIG. 11.

1) Upward angular movement of the shedding shafts; formation of the row-wise upper sheds; followed by pick insertion (12*r*) in the formed sheds 2) Reverting shedding shafts to the level position of the system 3) Insertion of the set of non-interlacing yarn (n1) between given two rows of the passive warp yarns (8)

4) Insertion of the set of diagonal non-interlacing yarn (n2) between given two diagonally occurring layers of the passive warp yarns (8)

5) Rightward linear movement of the shafts; formation of the right side columnwise sheds; followed by pick insertion (12*c*) in the formed sheds 6) Reverting shafts to the level position of the system 7) Insertion of the set of non-interlacing yarn (n3) between given two columns of the passive warp yarns (8)

8) Insertion of the set of diagonal non-interlacing yarn (n4) between given two diagonally occurring layers of the passive warp yarns (8)

9) Downward angular movement of the shafts; formation of the lower row-wise sheds; followed by pick insertion (12*r*) in the formed sheds 10) Reverting shafts to the level position of the system 11) Insertion of the set of non-interlacing yarn (n5) between given two rows of the passive warp yarns (8)

12) Insertion of the set of diagonal non-interlacing yarn (n6) between given two diagonally occurring layers of the passive warp yarns (8)

13) Leftward linear movement of the shafts; formation of the left sidecolumnwise sheds; followed by pick insertion (12*c*) in the formed sheds 14) Reverting shafts to the level position of the system 15) Insertion of the set of non-interlacing yarn (n7) between given two columns of the passive warp yarns (8)

16) Insertion of the set of diagonal non-interlacing yarn (n8) between given two diagonally occurring layers of the passive warp yarns (8).

Further, this method is not limited to the production of a block of either fabric construction (9) or (9*m*) or (9*n*) having either a square or a rectangle cross-section. By disposing the multilayer warp in accordance with the desired shape of cross-section, including tubular types with square or rectangle cross-section, and following suitable discrete sequence of operations described above, network-like fabric constructions either (9) or (9*m*) or (9*n*) of the corresponding cross-sectional profile can also be produced. It may be mentioned here that depending on the complexity of the cross-sectional profile being produced, more than one set of weft inserting means for each of the two directions can be employed. Such different sets of the weft inserting means of a given direction (i.e. row-wise or columnwise) may be operated either simultaneously or discretely to achieve the required weft insertion for the profile under production. This method of fabric production is therefore not limited to the production of a fabric of a particular cross-sectional profile. Further, because of the unique network-like interlacement, there is no need to carry out any separate binding operation at the exterior surfaces of the fabric to achieve the fabric integrity. This elimination of the binding process is apparently advantageous in simplifying and quickening the fabric production. Further, this method of producing network-like interlaced 3D fabric blocks and other cross-sectional profiles eliminates to the need to develop methods for producing certain cross-sectional shapes as from the produced block of the network-like fabric obtainable through this method, any desired shape of preform, filter etc. material can be easily cut obtained without the risk of its splitting up.

Figure 12A:
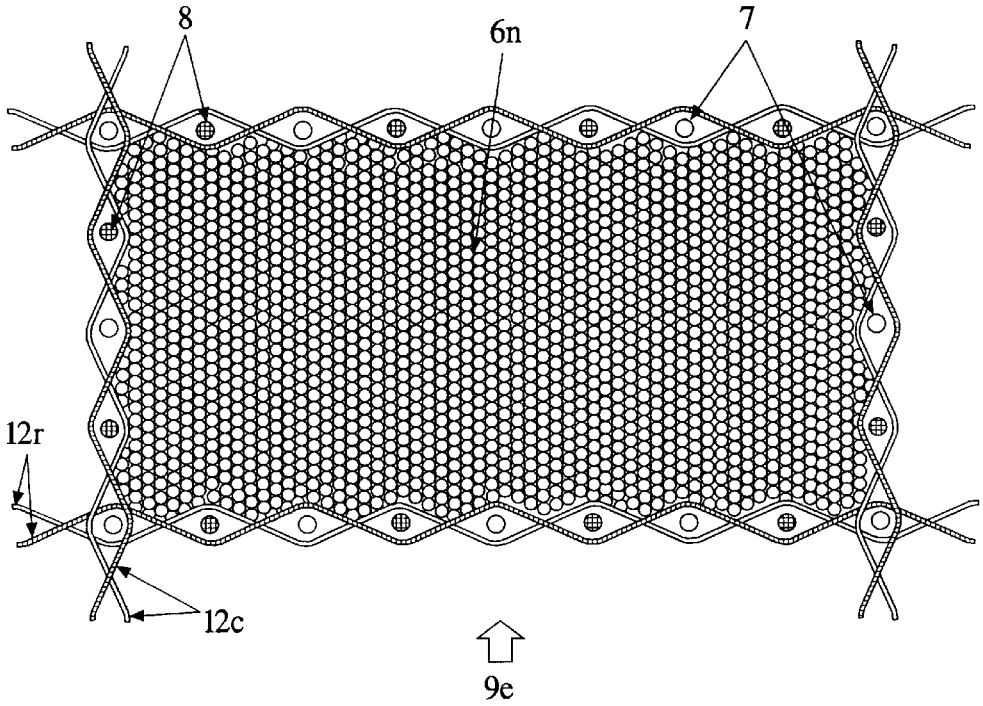
FIG. 12*a* is a two dimensional representation of the front view of a useful fabric construction producible in which the exterior part is only interlaced to function as a woven covering for the non-interlacing yarns which occur internally without interlacement.

Further, it is possible to produce another useful fabric material by carrying out shedding involving only the warp yarns occurring at the exteriors of the disposed multilayer warp (6) by suitably displacing the shafts (2), the healds (3) of which have been correspondingly threaded as described earlier. In reference to FIG. 12*a,* the top and the bottom woven surfaces can be produced by moving angularly the top and the bottom shafts (2), and hence displacing the healds (3), to displace the active warp yarns (7) to form row-wise sheds with the passive warp yarns (8) and inserting the wefts (12*r*) into these exterior top and bottom row-wise sheds. Similarly, the left and the right side woven surfaces can be produced by moving linearly the shafts (2), and hence displacing the healds (3), to displace the active warp yarns (7) to form columnwise sheds with the passive warp yarns (8) and inserting wefts (12*c*) into these exterior left and right columnwise sheds. Thus such operations will produce an interlaced exterior surface which will function as a woven covering for the internally occurring non-interlacing multilayer yarns (6*n*) of the fabric material (9*c*) as shown in FIG. 12*a*.

Figure 12B:
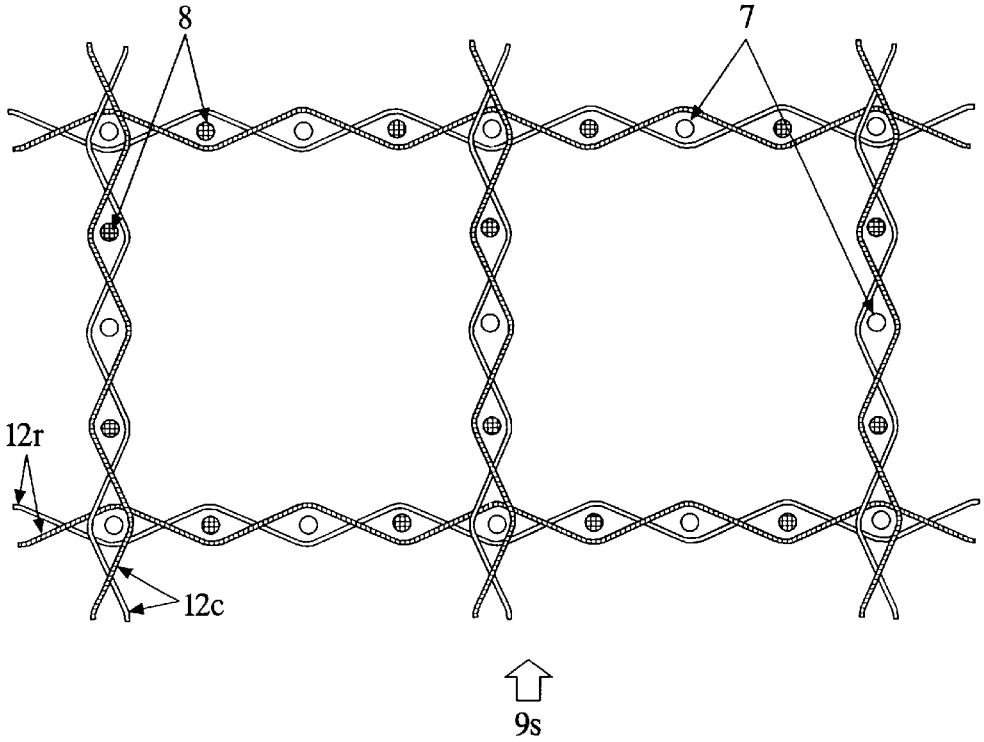
FIG. 12*b* is a two dimensional representation of the front view of a useful fabric construction producible in which specifically disposed yarns of the multilayer warp are interlaced to form a sandwich or a core type of fabric construction.

Further, it is also possible to produce a core or a sandwich type of fabric material (9*s*) shown in FIG. 12*b* by interlacing the suitably disposed multilayer warp yarns. Here again, by displacing independently the heald shafts (2), the healds (3) of which have been correspondingly threaded, the row-wise and the columnwise sheds can be respectively formed by moving these shafts (2) angularly and linearly as described earlier. Inserting wefts (12*r*) and (12*c*) into the formed row-wise and columnwise sheds respectively, the interlaced fabric structure (9*s*), generally referred to as sandwich or core type fabric structure, shown in FIG. 12*b* is obtained.

Further, it is also possible to produce multiple woven 2D fabric sheets employing the described shedding means. Such multiple sheets can be produced by disposing the multilayer warp as described before and moving the shafts (2) either angularly or linearly to form correspondingly either the row-wise or the columnwise sheds and inserting correspondingly either wefts (12*r*) or (12*c*) into the formed sheds of the given direction. Thus, by forming row-wise sheds and effecting corresponding picking, the multiple sheets of woven 2D fabric will be produced in the horizontal form. Similarly, by forming columnwise sheds and effecting corresponding picking, the multiple sheets of woven 2D fabric will be produced in the vertical form in reference to the arrangement shown in FIG. 3.

Needless to mention, in all the above described methods of fabric production, the other complementing operations of the weaving process like the beating-up, taking-up etc. will be carried out at the appropriate moments of the weaving cycle to produce a satisfactory fabric of the required specification.

It will be now apparent to those skilled in the art that it is possible to alter or modify the various details of this invention without departing form the spirit of the invention. Therefore, the foregoing description is for the purpose of illustrating the basic idea of this invention and it does not limit the claims which are listed below.

What is claimed is:

1. A device for producing woven material with a weaving method incorporating the operation of shedding in two mutually perpendicular directions to form row-wise and columnwise sheds in the multilayer warp disposed according to the cross-sectional profile of the fabric to be produced, said device comprising shedding means, said shedding means including:

one or more shafts, each shaft being reciprocable linearly along and angularly about a longitudinal axis;

each of the shafts include a means for supporting warp yarns extending in a length direction of the shafts such that a length direction of each of the included means is oriented perpendicular to the length direction of said shafts; and wherein said means supports is the warp yarns threaded through an entry port and an exit port of said means in accordance with the cross-sectional profile of the fabric to be produced.

2. The device according to claim 1, wherein the shedding means is dual-directional, said dual-directional shedding means comprising one or more sets of shedding shaft assemblies arranged in the following manner:

the longitudinal axis of the shafts occur in one or more parallel planes;

the longitudinal axis of the shafts occur in a perpendicular orientation to the axis of the disposed yarns of the multilayer warp;

two given shafts are spaced for drawing warp yarns therethrough; and each of the warp yarns drawn through the space between said two given shafts are surrounded by warp yarns threaded through said means for supporting warp yarns.

3. The device according to claim 2, wherein the dual-directional shedding shaft assemblies are reciprocable either linearly or angularly in one of the following manners:

collectively as a whole set;

in select groups;

individually; and in select groups and individually.

4. The device according to claim 2, wherein the dual-directional shedding shaft assemblies are reciprocable either linearly or angularly in one of the following manners:

in the same direction at the same time;

in the opposite directions at the same time; and in a discrete manner.

5. The device according to claim 2, wherein the dual-directional shedding means includes means for producing a material in which exterior warp yarns of the multiple layer warp are involved for interlacement with wefts, and such an outer interlaced assembly serves to function as a woven covering for elements which occur internally.

6. The device according to claim 2, wherein the dual-directional shedding means includes means for producing a material in which suitably disposed warp yarns of the multiple layer warp are involved for interlacement with wefts to result in a sandwich or core structure.

7. The device according to claim 1, wherein said device includes means for producing multiple woven 2D fabric sheets.

* * * * *